US007768410B2

(12) United States Patent
Chian

(10) Patent No.: US 7,768,410 B2
(45) Date of Patent: Aug. 3, 2010

(54) LEAKAGE DETECTION AND COMPENSATION SYSTEM

(75) Inventor: Brent Chian, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 1483 days.

(21) Appl. No.: 10/908,465

(22) Filed: May 12, 2005

(65) Prior Publication Data

US 2006/0257801 A1 Nov. 16, 2006

(51) Int. Cl.
*G08B 17/12* (2006.01)

(52) U.S. Cl. ..... 340/577; 340/578; 431/24

(58) Field of Classification Search ..... 340/577, 340/578–584, 693.5, 511, 507, 660–664; 431/24, 6; 327/113, 512, 518
See application file for complete search history.

(56) References Cited

U.S. PATENT DOCUMENTS

| | | | | |
|---|---|---|---|---|
| 3,909,816 | A | 9/1975 | Teeters | |
| 4,157,506 | A | 6/1979 | Spencer | |
| 4,221,557 | A | 9/1980 | Jalics | |
| 4,483,672 | A | 11/1984 | Wallace et al. | |
| 4,655,705 | A | 4/1987 | Shute et al. | |
| 4,695,246 | A | 9/1987 | Beilfuss et al. | |
| 4,830,601 | A | 5/1989 | Dahlander et al. | |
| 4,842,510 | A | 6/1989 | Grunden et al. | |
| 4,872,828 | A | 10/1989 | Mierzwinski | |
| 4,955,806 | A | 9/1990 | Grunden et al. | |
| 5,026,270 | A * | 6/1991 | Adams et al. | 431/24 |
| 5,026,272 | A * | 6/1991 | Takahashi et al. | 431/79 |
| 5,037,291 | A | 8/1991 | Clark | |
| 5,073,769 | A * | 12/1991 | Kompelien | 340/578 |
| 5,077,550 | A | 12/1991 | Cormier | |
| 5,112,117 | A | 5/1992 | Altmann et al. | |
| 5,126,721 | A | 6/1992 | Butcher et al. | |
| 5,158,447 | A | 10/1992 | Geary | |

(Continued)

FOREIGN PATENT DOCUMENTS

| | | |
|---|---|---|
| EP | 0967440 | 12/1999 |

(Continued)

OTHER PUBLICATIONS www.playhookey.com, "Series LC Circuits," 5 pages, printed Jun. 15, 2007.

(Continued)

*Primary Examiner*—Anh V La
(74) *Attorney, Agent, or Firm*—Crompton Seager & Tufte LLC

(57) ABSTRACT

A flame sensing system having a flame rod, a signal generator, a signal measurement circuit, and a controller, where the frequency and/or amplitude of the excitation signal may be variable. The signal measurement circuit may include a bias circuitry that references the flame signal to a voltage, a capacitor that varies the filtration, an AC coupling capacitor, a current limiting resistor, and a low-pass filter. The system may determine the flame-sensing rod contamination, the stray capacitance of the flame sensing system, and compensate for stray capacitance in the flame sensing system. The flame model may include a circuit that simulates a flame in the presence of the sensing rod, and another circuit that simulates a contact surface between the flame and the sensing rod.

20 Claims, 7 Drawing Sheets

U.S. PATENT DOCUMENTS

| | | | | |
|---|---|---|---|---|
| 5,175,439 | A | | 12/1992 | Harer et al. |
| 5,222,888 | A | | 6/1993 | Jones et al. |
| 5,236,328 | A | | 8/1993 | Tate et al. |
| 5,255,179 | A | | 10/1993 | Zekan et al. |
| 5,280,802 | A | | 1/1994 | Comuzie, Jr. |
| 5,300,836 | A | * | 4/1994 | Cha ..... 327/113 |
| 5,347,982 | A | | 9/1994 | Binzer et al. |
| 5,391,074 | A | | 2/1995 | Meeker |
| 5,424,554 | A | | 6/1995 | Marran et al. |
| 5,506,569 | A | | 4/1996 | Rowlette |
| 5,567,143 | A | | 10/1996 | Servidio |
| 5,797,358 | A | | 8/1998 | Brandt et al. |
| 5,971,745 | A | | 10/1999 | Bassett et al. |
| 6,060,719 | A | | 5/2000 | DiTucci et al. |
| 6,084,518 | A | | 7/2000 | Jamieson |
| 6,222,719 | B1 | | 4/2001 | Kadah |
| 6,299,433 | B1 | | 10/2001 | Gauba et al. |
| 6,509,838 | B1 | | 1/2003 | Payne et al. |
| 6,743,010 | B2 | | 6/2004 | Bridgeman et al. |
| 6,794,771 | B2 | | 9/2004 | Orloff |
| 2002/0099474 | A1 | | 7/2002 | Khesin |
| 2003/0064335 | A1 | | 4/2003 | Canon |
| 2004/0209209 | A1 | | 10/2004 | Chodacki et al. |

FOREIGN PATENT DOCUMENTS

| | | |
|---|---|---|
| EP | 1148298 | 10/2001 |
| WO | 9718417 | 5/1997 |

OTHER PUBLICATIONS

Honeywell, "S4965 SERIES Combined Valve and Boiler Control Systems," 16 pages, prior to the filing date of present application.
Honeywell, "SV9410/SV9420; SV9510/SV9520; SV9610/SV9620 SmartValve System Controls," Installation Instructions, 16 pages, 2003.

* cited by examiner

LEAKAGE DETECTION AND COMPENSATION SYSTEM

BACKGROUND

The present invention pertains to flame sensing, and particularly to AC leakage detection and compensation relative to flame sensing. More particularly, it pertains to detection and compensation for AC leakage and contamination relative to flame-sensing rods.

The present application is related to the following indicated patent applications: "Dynamic DC Biasing and Leakage Compensation", U.S. application Ser. No. 10/908,463, filed May 12, 2005; "Flame Sensing System", U.S. application Ser. No. 10/908,466, filed May 12, 2005; and "Adaptive Spark Ignition and Flame Sensing Signal Generation System", U.S. application Ser. No. 10/908,467, filed May 12, 2005; which are all incorporated herein by reference.

SUMMARY

The present invention relates generally to flame sensing circuitry, using a relatively high frequency, of a combustion system and more particularly relates to AC leakage and flame rod contamination detection and compensation of a flame signal.

DESCRIPTION

Figure 1:
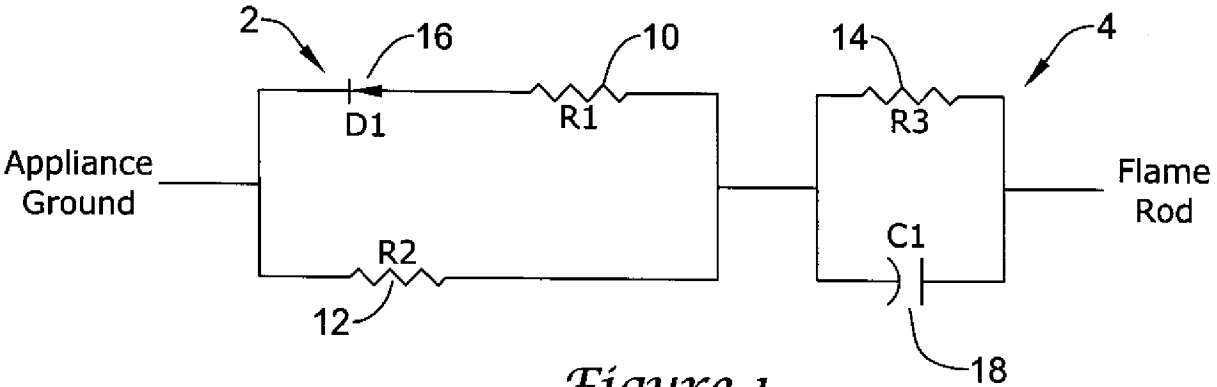
FIG. 1 is a schematic diagram of an illustrative example of a flame model.

There may be a need to detect or compensate contamination build-up on a flame-sensing rod in a combustion system. A flame-sensing rod may be located in a burner of the combustion system to sense the status of the burner, for example, on or off, and then output a signal to a controller signaling the status of the burner. A flame-sensing system may use 50 or 60 hertz line power as excitation energy for the flame signal. Additionally, a system may require a minimum flame current to reliably detect the flame. When the flame-sensing rod is positioned in the burner of the combustion system for an extended period of time, a contamination layer may build-up on the surface of the flame-sensing rod. The contamination layer may be attributable to the contamination in the air that is deposited on the flame-sensing rod while the burner is burning. This contamination layer may act as a resistive layer decreasing the signal strength of the flame signal. If the contamination build-up is great enough, the flame signal may be small enough so that it is undetectable by the controller. This may cause many complications with the operation of the combustion system, leading to frequent maintenance of the combustion system.

Flame sensing systems may have heavy filtration that results in slow response times. It may be desirable to have a flame sensing system that is capable of a fast response time and that can determine and compensate for contamination build-up on the flame-sensing rod. Using a high frequency flame excitation signal may help to speed up system response time. But if the flame sensing wire is long, it may create a relatively high stray capacitance that reduces the flame signal. It may be desirable to detect and compensate the AC leakage effect of the stray capacitance.

In one illustrative example, an approach of operating a flame sensing system may include providing a flame excitation signal at a first frequency, determining a characteristic of the flame signal, and adjusting the first frequency of the flame excitation signal to a second or next frequency. The illustrative example may also include connecting an additional component to the flame sensing system. In some cases, the characteristic may be stored in memory. The characteristic of the flame signal at the second or next frequency may be substantially similar to the characteristic of the first flame signal. The characteristic of the flame at the second or next frequency may be stored in memory. In one case, a characteristic of the flame signal may be the alternating current (AC) component of the flame signal.

In another case, the illustrative example may further include determining the characteristic at the second or next frequency, applying a calibration value to the characteristic at the second or next frequency, comparing the characteristic at the first frequency and to the calibrated characteristic at the second or next frequency, storing the change between the characteristic at the first frequency to the characteristic at the second or next frequency after calibration, in the memory, and providing a controller to control the flame sensing system if the change in the characteristic stored in the memory is outside a threshold range. In addition, the controller may control the flame sensing system by varying the excitation signal strength. Alternatively, the controller may control the flame sensing system by providing a warning signal. In some cases, the flame rod contamination rate may be controlled by adjusting the excitation signal amplitude. In one case, the characteristic of the first flame signal may be the flame current.

In another illustrative example, an approach of determining capacitance may include providing a flame signal where the flame rod and a wire are attached, determining a characteristic of the flame signal, comparing the characteristic of the flame signal to a stored value, and calculating the stray capacitance. In one case, applying a numerical correction to the flame signal may compensate the effect of the stray capacitance. In another case, adjusting the excitation signal strength may compensate the effect of stray capacitance.

In yet another illustrative example, a flame sensing system may include a flame rod, a signal generator that generates an excitation signal, a signal measurement circuit, and a controller to control the excitation signal, where the frequency and/or amplitude of the excitation signal may be varied. In some cases, the signal measurement circuit may include a bias circuitry that references the flame signal to a voltage, a capacitor that varies the filtration, an AC coupling capacitor, a current limiting resistor, and a low-pass filter.

In another illustrative example, a flame model may include a circuit that simulates the flame, where the circuit includes a two resistors and a diode, and another circuit that simulates a contact surface between the flame and the flame sensing rod, where the latter circuit includes a third resistor and a capacitor.

FIG. 1 is a schematic diagram of an illustrative example of a flame model. The flame model may include a circuit 2 that may simulate a flame and a circuit 4 that may simulate the contact surface between the flame and the flame-sensing rod. In the example, the flame model may simulate a flame in a combustion system, such as a furnace.

The circuit 2 may include a resistor 10, a resistor 12, and a diode 16. In some cases, the resistor 10 may be in series with the diode 16. The second resistor 12 may be situated in parallel with the resistor 10 and the diode 16. More generally, any circuit that simulates the flame may be used, as desired. In some cases, the resistor 10 and the resistor 12 may be in the range of 1 to 200 mega ohms. Also, in some cases the voltage across the circuits may be in the range of 100 volts or higher. However, it is contemplated that any desirable resistance, current, or voltage may be used to simulate the flame and the flame sensing system, as desired.

The circuit 4 may include a resistor 14 and a capacitor 18. In some cases, the resistor 14 and capacitor 18 may be situated in parallel with each other. More generally, any circuit that can simulate the flame to rod contact surface may be used, as desired. In the example, in the case of no contamination, the resistor 14 may be relatively small. Alternatively, under the circumstance where contamination build-up may be present on the flame-sensing rod, the resistor 14 may have a higher resistance than when there is no contamination. This higher resistance may decrease the flame signal, making it more difficult to detect. The capacitance of 18 may also change with contamination. By varying the frequency of the flame excitation signal, there may be a better flame current, enabling detection of the flame even when the contamination on the surface of the flame-sensing rod is heavy. When the excitation frequency is a lower frequency, the capacitor 18 may have a higher impedance and may have a less substantial effect on the circuit. When there is a higher excitation frequency, the capacitor 18 may have a greater effect on the circuit and may provide a capacitance path for the flame signal to travel. In this case, the effect of the resistor 14, which may have a higher resistance, may be less significant.

In the example, the circuit 2 and the circuit 4 may be situated in series with each other. However, any other equivalent arrangement of the circuit 2 and the circuit 4 may be used, as desired.

Figure 2:
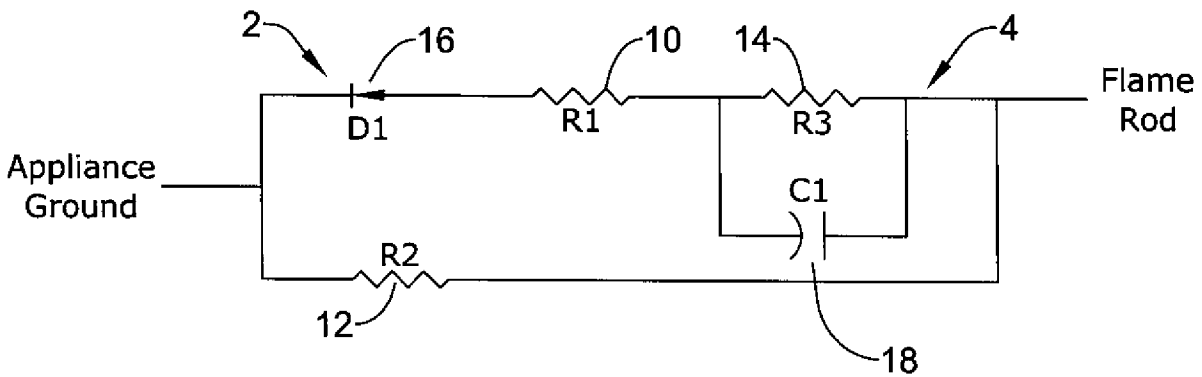
FIG. 2 is a schematic diagram of another illustrative example of a flame model.

FIG. 2 is a schematic diagram of another illustrative example of a flame model. The example may be an equivalent circuit to that of FIG. 1. As illustrated, the circuit 4 is situated in series with the diode 16 and resistor 10 of the circuit 2. This series combination may then be situated in parallel with the resistor 12. More generally, any equivalent circuit to the example in FIG. 1 or FIG. 2 is contemplated and may be used, as desired.

Figure 3:
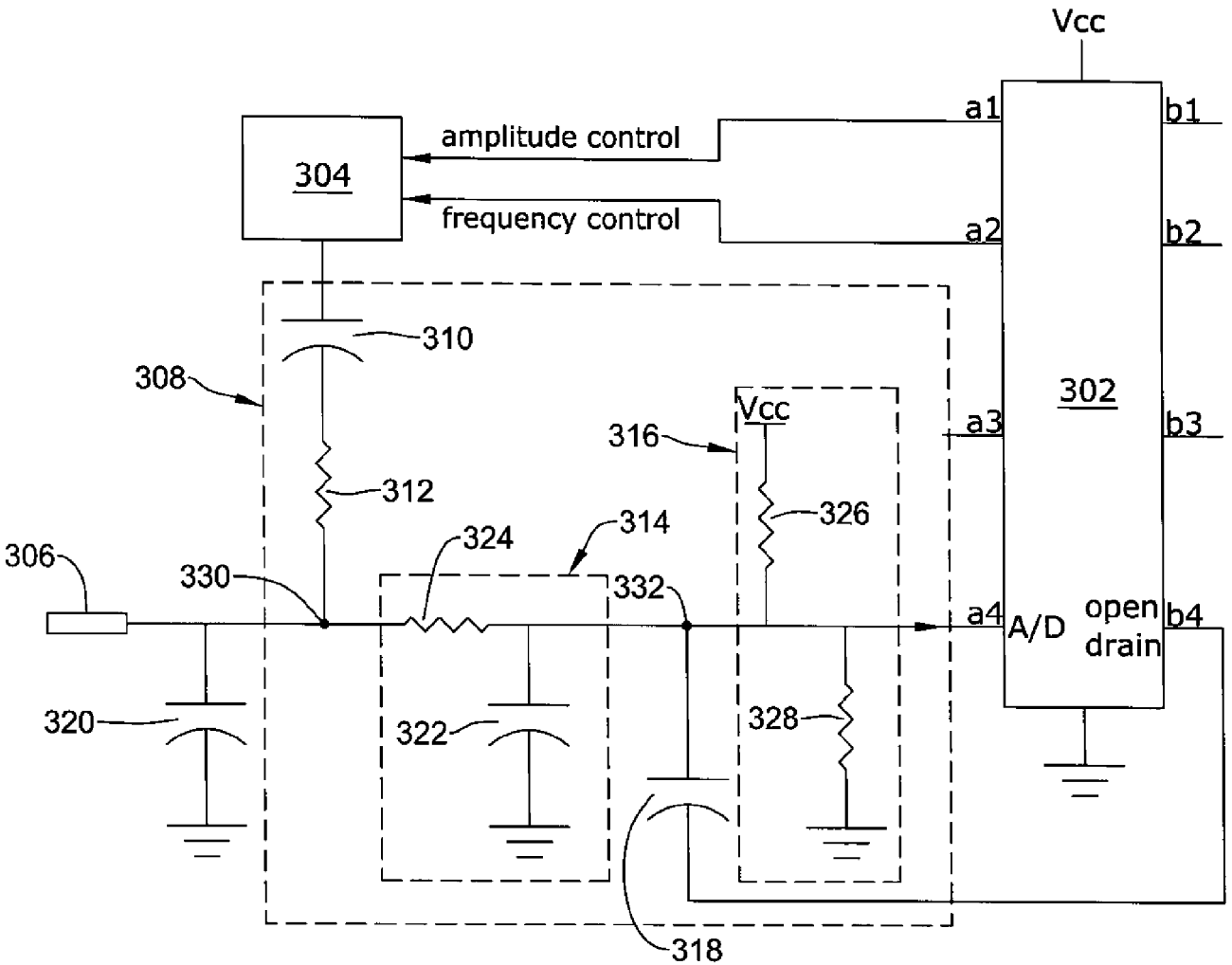
FIG. 3 is a schematic diagram of an illustrative example of a flame sensing system.

FIG. 3 is a schematic diagram of an illustrative example of a flame sensing system. The flame sensing system may include a flame-sensing rod 306, a signal generator 304 that generates an excitation signal, and a controller 302 to control the frequency and the amplitude of the excitation signal, where the frequency and/or the amplitude of the excitation signal may be variable. The flame sensing system may also include a signal measurement circuit 308. In some cases, the signal measurement circuit 308 may include an alternating current (AC) coupling capacitor 310, a current limiting resistor 312, a low-pass filter 314, a bias circuit 316, and a capacitor 318. In some cases, the flame sensing system may also include a capacitor 320 which may simulate the stray capacitance. In one case, the signal generator 304 may be a high voltage AC excitation signal generator. The signal generator 304 may have a variable frequency and a variable amplitude control. The variable amplitude control may include an on/off control. Having a variable frequency and amplitude for the excitation signal may be advantageous under some circumstance. For example, if the contact resistance (R3) 14 is high, a higher frequency may be needed to penetrate the contact surface via the capacitance (C1) 18. But if the stray capacitance 320 is relatively high, the high-frequency flame excitation signal may be greatly reduced which may cause problems detecting the flame signal. In this case, the high frequency may be needed along with increasing the excitation signal amplitude to boost the flame signal strength. Another consideration in determining the excitation signal strength is that the flame-sensing rod 306 surface contamination may increase at a greater rate with higher excitation signal. The excitation signal frequency may be determined with the flame response time requirement and rod condition to maintain a desired flame signal level at the flame-sensing rod 306. The excitation frequency and amplitude may be adjusted to maintain the desired flame-signal as the flame-sensing rod 306 becomes more contaminated. Under some circumstances, it may be desirable to have an initial low excitation energy and to increase the excitation energy or frequency as desired.

In the example, the controller 302 may have a flame sensing algorithm package installed. The controller 302 may control the signal generator 304, such as the frequency, amplitude, or any other parameters, as desired. Additionally, the controller 302 may detect and store characteristics of the flame signal. In some cases, the characteristics may be the AC component of the signal and/or the frequency of the flame signal. The controller 302 may sense the flame signal at the A-to-D input pin of the controller 302. The controller 302 may control the capacitor 318, which may attach to the open-drain output of the controller 302. In some cases, the controller 302 may be a micro-controller.

The AC coupling capacitor 310 may be situated next to the signal generator 304. The AC coupling capacitor 310 may allow the AC component of the excitation signal to pass and block the direct current (DC) component of the excitation signal. In some cases, the AC coupling capacitor 310 may have a small capacitance. However, any capacitance as desired may be used. As illustrated, the current limiting resistor 312 may be situated next to the excitation signal generator 304. The current limiting resistor 312 may limit the current flow of the signal to a maximum value for safety reasons, as well as other reasons. In some cases, the current limiting resistor 312 may have a high resistance, low resistance, or any resistance as desired.

In the example, node 1 330 may be shown between the current limiting resistor 312 and the low-pass filter 314. In some cases, node 1 330 may have a voltage of approximately 300 volts AC peak-to-peak. However, there may be any voltage at node 1 as desired. Between node 1 and the flame sensing A/D input of the controller 302 may be a low-pass filter 314 and a bias circuit 316. The low-pass filter 314 may attenuate the AC component of the flame signal so that the AC signal amplitude may be within the linear range of the AD converter, but may yet be high enough to be detectable by the controller. The low-pass filter 314 may include a resistor 324 and a capacitor 322. The bias circuitry 316 may reference the voltage of the signal to a desired value. In other words, the bias circuitry may set the bias voltage of the detected flame signal. In some cases, the DC component of the flame signal may be negative in polarity; the bias circuit 316 may pull up the signal to positive so that the A/D converter may better sense the signal. The bias circuit 316 may include resistor 326 and resistor 328. The values of the resistor may be any values that may give a desired reference voltage to the flame excitation signal, as desired.

In the example, node 2 332 may be located between the low-pass filter 314 and the bias circuitry 316. Between node 2 and the open-drain I/O pin of the controller 302 may be the capacitor 318. In some cases, capacitor 318 may vary the filtration of the flame sensing system. In some cases, the open-drain I/O pin may act similar to a MOSFET. There may be no pull-up resistance. If the pin is on, it may ground the pin, if off, there is no connection. Under some circumstances, capacitor 318 may be attached or unattached as controlled by the controller. The capacitor 318 may be controllable. In some cases, the frequency can vary in a wide range without generating too high or too low AC component at the A/D input. In one case, if a higher frequency is used, the capacitor 318 may be disconnected. In another case, if a lower frequency is used, the capacitor 318 may be engaged to reduce the AC component of the flame excitation signal so that the A/D input may handle the signal. Under some circumstances, the capacitance value may be determined to make the AC component signal at the A/D about the same level when the frequency is changed. For example, if the frequency can be 1 kHz or 20 kHz, the capacitor 318 may have about 19 times the value of the capacitor 322 in the low-pass filter. More additional capacitors and their controlling pins may be used as necessary if more excitation frequencies are to be used. Adding the additional capacitor may be a way to handle the AC component change. Another way to handle AC component amplitude change when frequency of the excitation signal changes may be to select the low-pass filter so that the AC component amplitude is within the linear range of the A/D when the frequency is at the lowest. This may need good A/D resolution or wide dynamic range of the A/D.

Still another method may be to heavily filter the AC component. This will disable some of the other features of this invention but works fine with claim 1 related part.

Between node 1 330 and the ground may be a capacitor 320 to simulate the stray capacitance between the flame wire (including flame rod) and the ground. This capacitor 320 may act as part of a voltage divider under some circumstances. In some cases, the capacitor 320 may be in the range of 20 to 200 picofarads. However, any capacitance value that may represent the real stray capacitance may be used, as desired. The flame sensing circuit may be able to detect and compensate the effect of capacitor 320. If the signal generator 304 provides a higher frequency excitation signal, the flame signal loss due to this capacitance may be increased. In some cases, the signal frequency may be in the range of 10 to 20 kHz. However, any frequency may be provided by the signal generator, as desired.

One advantage of the example is the reduced filtration of the system. By having reduced filtration, the AC component of the flame signal may be less depleted at the A-to-D input of the controller 302. Some flame-sensing systems may have greater filtration, such as multiple stages of low-pass filter 314, which reduce the AC component of the flame signal and slow down the system response time. Additionally, since the example may have a reduced filtration, the flame sensing system may have a much quicker system response time. The quicker system response time may allow the detection of fast flame level changes, which some other systems do not allow for. The fast system response time may be needed for many applications. Furthermore, by having fewer components, the cost may also be less than other systems.

Figure 4:
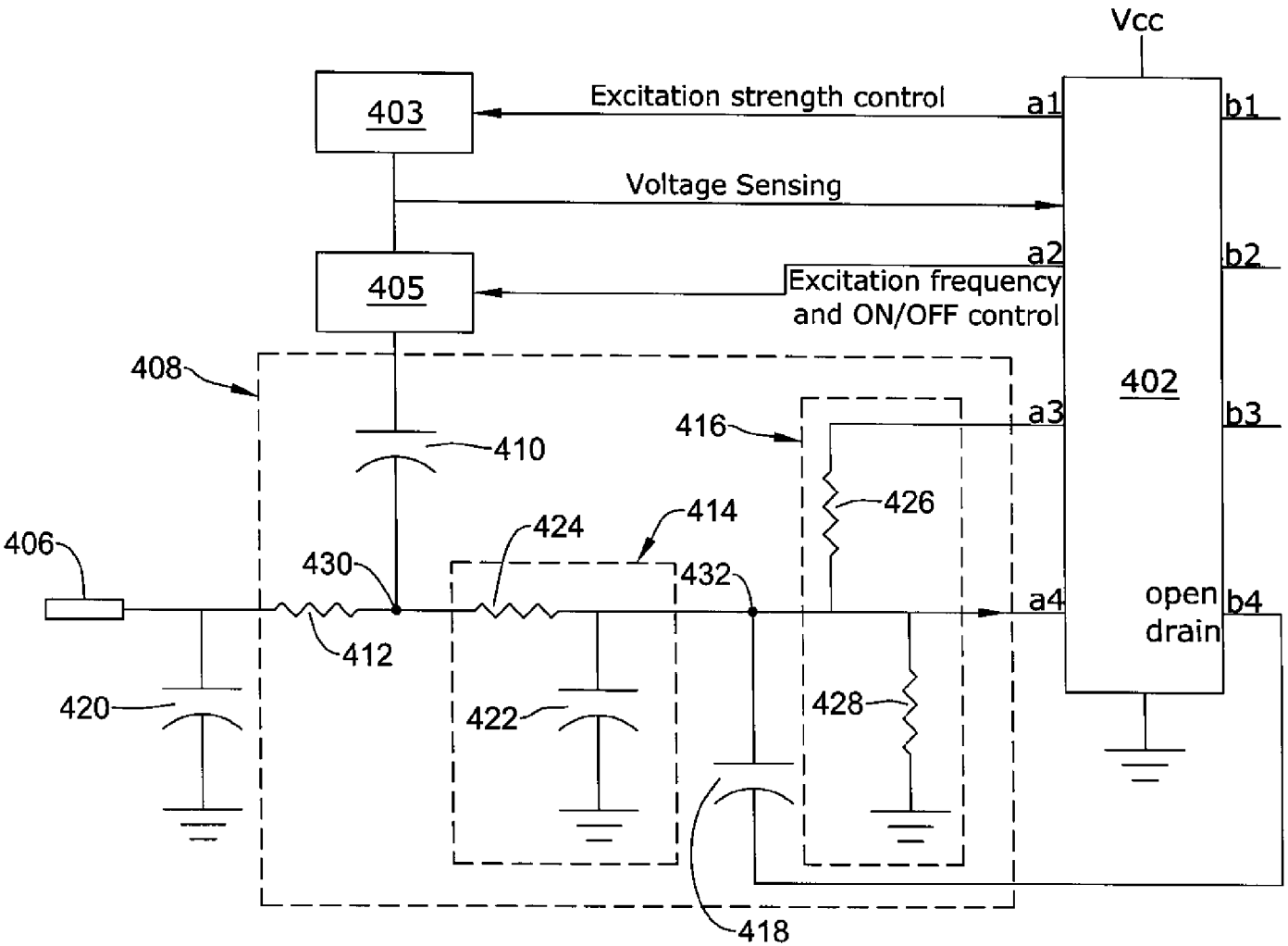
FIG. 4 is schematic diagram of another illustrative example of a flame sensing system.

FIG. 4 is schematic diagram of another illustrative example of a flame sensing system. The flame sensing system is similar to the example of FIG. 3. However, the signal generator may include a variable high voltage DC generator 403 and an AC excitation signal generator 405. The controller may still control and vary the excitation signal strength and the excitation signal frequency. In this example, the current limiting resistor 412 may be situated between node 1 430 and the flame rod 406 as opposed to between node 1 430 and the AC coupling capacitor 410.

Figure 5:
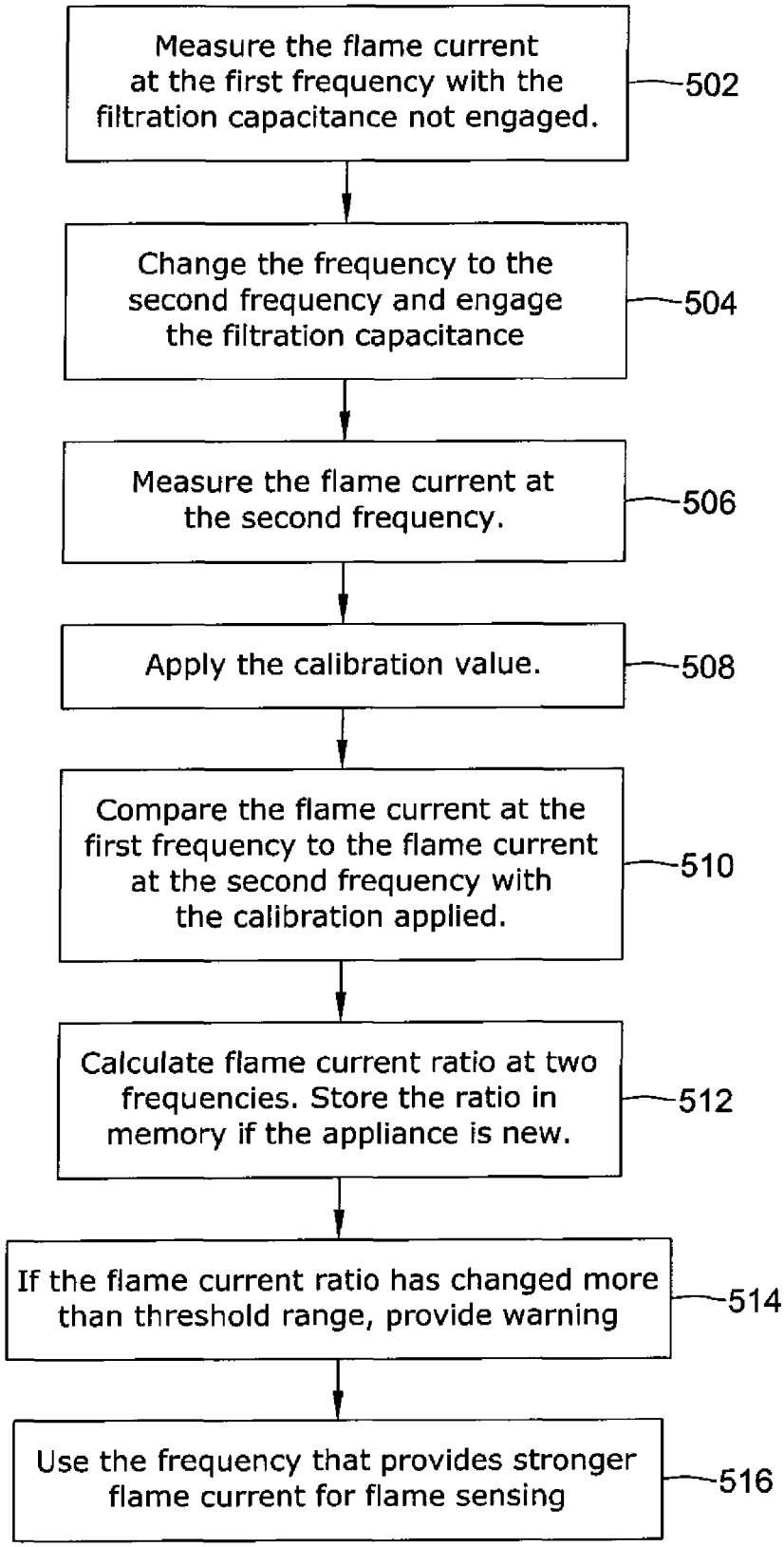
FIG. 5 is a schematic flow chart of an illustrative process of overcoming rod surface contamination.

FIG. 5 is a schematic flow chart of an illustrative process of detecting and overcoming rod surface contamination. Under some circumstances, it may be desirable to obtain more information about the flame or condition of the flame-sensing rod and burn assembly. The flame current may be measured at the first frequency with the additional filtration capacitance not engaged 502. The frequency may be changed to the second or next frequency and the additional filtration capacitor may be engaged 504. The second or next frequency may be the lower frequency determined and stored during calibration. The flame current may be measured at the second frequency 506. Then the calibration value may be applied to the measured value of the flame signal 508. Then the flame current at the first frequency may be compared to the flame current after the calibration has been applied 510. The flame current ratio at two different frequencies may be calculated. If the appliance is new (the flame rod surface is clean), this ratio may be stored in non-volatile memory 512. Later if the ratio is changed significantly, then the rod may have a contamination layer. The controller may vary the excitation signal strength to compensate rod contamination (not shown). In some cases, the controller may provide a warning signal to the user for the contamination 514. The system may use the frequency that produces higher flame current for flame sensing during most of the normal running time 516. When a fast system response time is important, the system may use the frequency that provides faster response for flame sensing (not shown).

Figure 6:
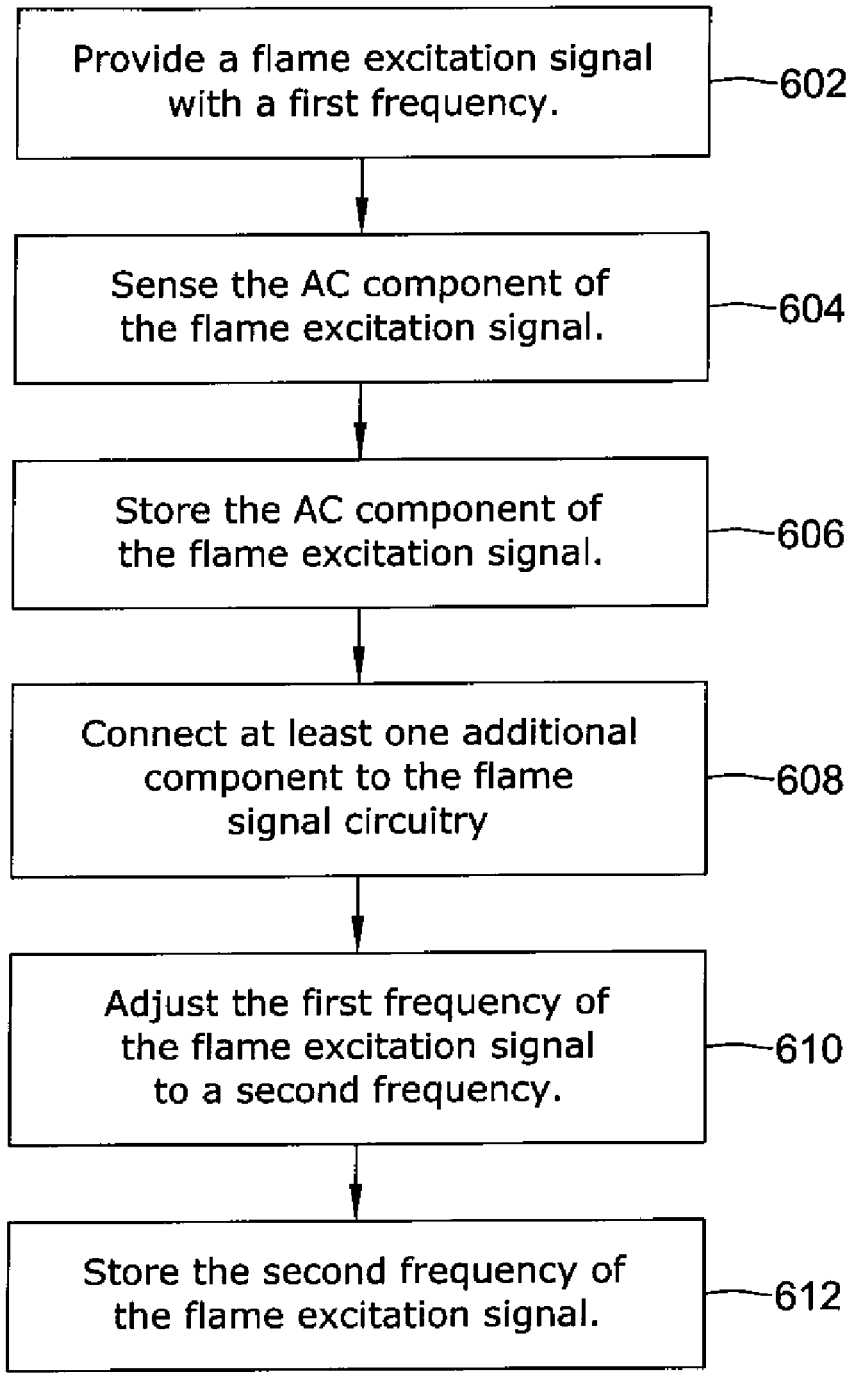
FIG. 6 is a schematic flow chart of an illustrative process of calibrating the flame sensing system.

FIG. 6 is a schematic flow chart of an illustrative process of calibrating the additional filtration capacitor. In some cases, the flame sensing system may be calibrated at the factory prior to shipping. Alternatively, in other cases, the flame sensing system may be calibrated after it has been shipped. When calibrating, the flame wire and flame-sensing rod may be unattached from the sensing system. The controller may provide a flame excitation signal at a first frequency 602. The flame excitation signal may have a fixed voltage level and the additional filtration capacitor may be disengaged to the flame sensing system. A component of the flame excitation signal may then be sensed 604 by the controller. In some cases, the component of the flame excitation signal may be an AC component. The AC component of the flame excitation signal may be sensed by the controller at its A/D input. This value of the AC component may be stored and saved as the calibration AC component 606. Then, an additional component may be connected to the flame signal circuitry 608. In some cases, the additional component may be the additional filtration capacitor. However, any additional circuitry may be connected to the flame sensing system, as desired. Next, the frequency of the flame signal may be adjusted to a second frequency 610. At the second frequency, the amplitude of the AC component of the excitation signal may be the same as the amplitude of the AC component at the first frequency. In some cases, the voltage level of the flame excitation signal may be substantially maintained. This second frequency may be a lower frequency than the first frequency. However, under some circumstances, the second frequency may be higher than the first frequency, the same frequency, or any frequency as desired. The second frequency may be stored in memory 612. In some cases, the memory may be non-volatile memory. The second frequency may be used in run time as the lower frequency.

Alternatively, the control may use two fixed frequencies and may calculate a calibration constant to compensate for the inaccuracies of the additional filtration capacitor. The calibration constant may be stored in memory. The memory may be non-volatile memory. The calibration constant may be used in run time.

Figure 7:
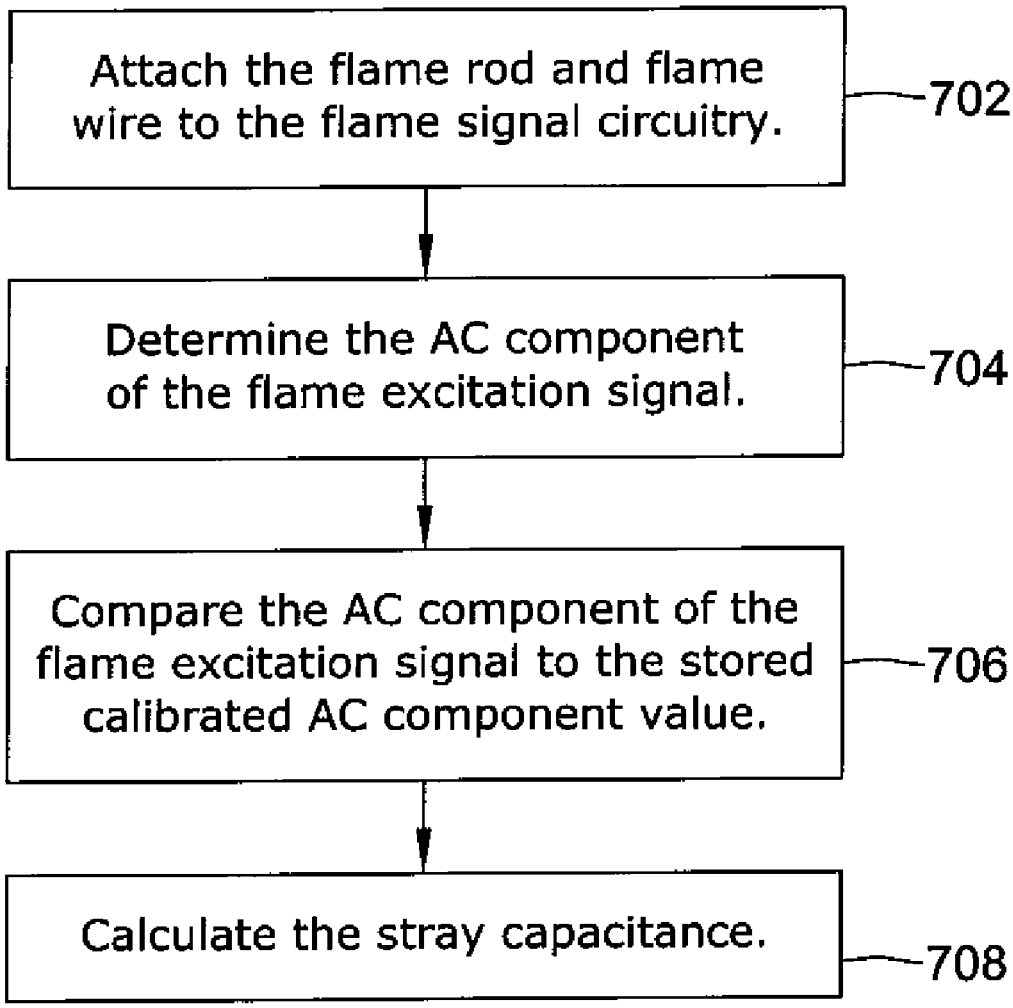
FIG. 7 is a schematic flow chart of an illustrative process of determining the stray capacitance in a combustion system.

FIG. 7 is a schematic flow chart of an illustrative process of determining the effect of stray capacitance on a flame sensing system. In some cases, the effect of stray capacitance may be determined after installation of the system prior to the first time of normal operation of the combustion system. The flame-sensing rod and flame wire may be attached to the flame signal circuitry 702. The controller 704 may detect the AC component of the flame signal. When being detected, the flame might not be established so that there may be little or no current flowing to or from the flame sensing rod, and the flame signal may have the same excitation voltage as during calibration and the first frequency as used during calibration step 604. The AC component of the flame signal may be compared to the stored calibrated AC component value 706. Then the stray capacitance may be calculated 708. In one case, if there is a stray capacitance created by the flame sensing system, the AC component may be lower then the calibrated AC component. However, the effect of stray capacitance may cause any change in the AC component of the flame signal.

Figure 8:
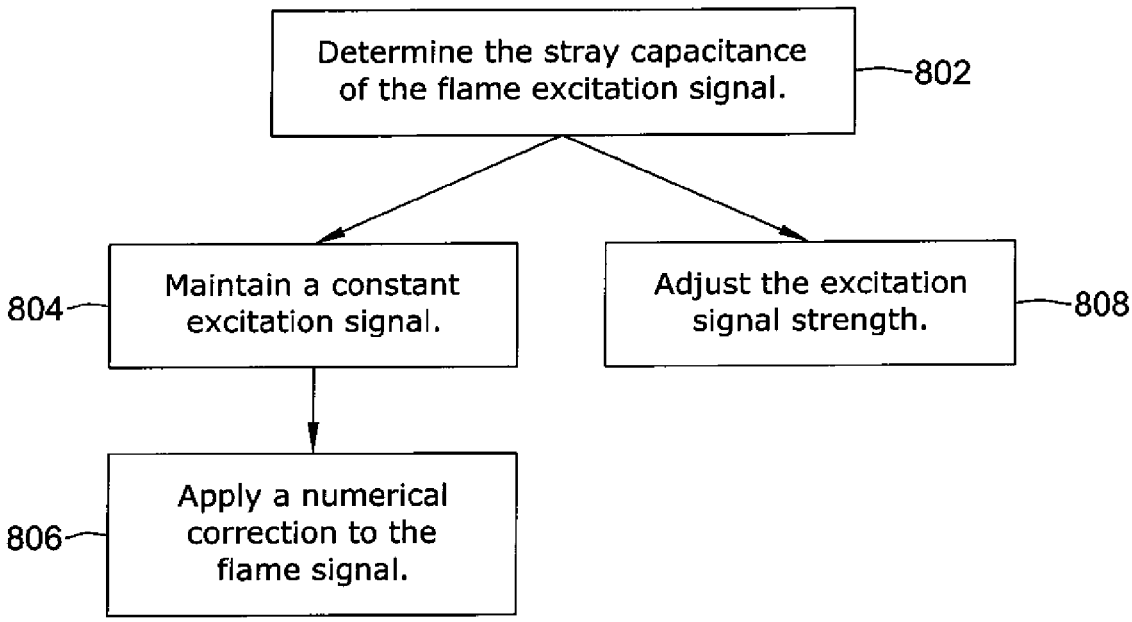
FIG. 8 is a schematic flow chart of an illustrative process of compensating the flame sensing system for stray capacitance.

FIG. 8 is a schematic flow chart of an illustrative process of compensating the flame sensing system for the effect of stray capacitance. If it is determined that there is stray capacitance in the flame sensing system 802, the flame signal may be compensated. The effect of stray capacitance on the flame-sensing rod may reduce the excitation signal strength at the flame. One illustrative approach of flame signal compensation is to apply a numerical correction to the flame signal 806. The controller may apply the numerical correction. In some cases, the excitation signal may remain constant 804. Another illustrative approach to compensate the flame signal is to adjust the excitation signal amplitude 808, so that the AC component may be maintained at the same level as in calibration step 606.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A method of operating a flame sensing system comprising:

providing a flame sensing system, the flame sensing system comprising:

a signal generator; and a controller;

providing a flame excitation signal from the signal generator, the signal having a frequency set at a first frequency;

determining at least one characteristic of the flame signal;

adjusting the frequency of the flame excitation signal to a next frequency;

determining the at least one characteristic of the flame signal at the next frequency;

applying a compensated value to the at least one characteristic at the next frequency;

comparing the at least one characteristic at the first frequency to the compensated value of the at least one characteristic at the next frequency;

storing a change and/or ratio between the at least one characteristic at the first frequency to the compensated value of the at least one characteristic at the next frequency in a memory; and using the controller to control the flame sensing system if the change and/or ratio in the at least one characteristic of the flame signal stored is outside a threshold range.

2. The method of claim 1, wherein the at least one characteristic of the flame excitation is an amplitude of a flame current.

3. The method of claim 1, wherein the storing a change stores a ratio of the at least one characteristic of the flame signal at different frequencies in a history file to monitor contamination of a sensing rod.

4. The method of claim 1, wherein the controller controls the flame sensing system by varying an excitation signal strength.

5. The method of claim 1, wherein the controller controls the flame sensing system by providing a warning signal.

6. The method of claim 1, wherein an effect of contamination is indicated by a change of the ratio of the at least one characteristic at different frequencies.

7. The method of claim 1, wherein the controller compensates the effect of rod contamination by varying an excitation signal strength.

8. The method of claim 1, wherein the at least one characteristic of the flame signal is a flame current.

9. The method of claim 1, further comprising connecting at least one additional component to the flame sensing system.

10. The method of claim 9, further comprising:

storing a change and/or ratio between the at least one characteristic at the first frequency to the at least one characteristic at the next frequency after calibration in a memory.

11. The method of claim 10, wherein the storing a change stores a ratio of the at least one characteristic of the flame signal at different frequencies in a history file to monitor contamination.

12. The method of claim 10, wherein the controller controls the flame sensing system by varying an excitation signal strength.

13. The method of claim 10, wherein the controller controls the flame sensing system by providing a warning signal.

14. The method of claim 10, wherein an effect of contamination is indicated by a change of a ratio of the at least one characteristic at different frequencies.

15. The method of claim 10, wherein the controller compensates the effect of rod contamination by varying an excitation signal strength.

16. The method of claim 10, wherein the at least one characteristic of the flame signal is a flame current.

17. The method of claim 1, wherein the at least one characteristic of the flame signal is stored in memory.

18. The method of claim 1, wherein the at least one additional component connected to the flame signal system is a capacitor that varies filtration and response time of the system.

19. The method of claim 1, wherein a frequency that produces the higher flame current is used for flame sensing.

20. The method of claim 1, wherein a frequency that produces the acceptable flame current and fast system response time is used for flame sensing when fast response is needed.

* * * * *